United States Patent [19]

Treacy

[11] 4,193,717

[45] Mar. 18, 1980

[54] SHORING ASSEMBLY FOR A TRENCH OR HOLE

[76] Inventor: Thomas P. Treacy, 56 Scribers La., Hall Green, Birmingham 28, England

[21] Appl. No.: 883,938

[22] Filed: Mar. 6, 1978

[30] Foreign Application Priority Data

Mar. 5, 1977 [GB] United Kingdom ..... 9380/77

[51] Int. Cl.[2] ..... E02D 19/00

[52] U.S. Cl. ..... 405/283

[58] Field of Search ..... 61/41 A, 41 R, 63, 105, 61/106

[56] References Cited

U.S. PATENT DOCUMENTS

| | | | |
|---|---|---|---|
| 892,538 | 7/1908 | Morrill | 61/41 A |
| 1,574,820 | 3/1926 | Jones | 61/41 A |
| 2,865,178 | 12/1958 | Wicke | 61/41 A |
| 2,908,140 | 10/1959 | Everson | 61/41 A |
| 3,295,330 | 1/1967 | Meshorer | 61/41 A |
| 3,541,799 | 11/1970 | Jost et al. | 61/41 A |
| 4,002,035 | 1/1977 | Wright | 61/41 A |
| 4,056,938 | 11/1977 | Griswold | 61/41 A |

FOREIGN PATENT DOCUMENTS

| | | | |
|---|---|---|---|
| 351779 | 4/1922 | Fed. Rep. of Germany . | |
| 2461255 | 1/1976 | Fed. Rep. of Germany | 61/41 A |
| 911737 | 11/1962 | United Kingdom . | |
| 1295940 | 11/1972 | United Kingdom . | |
| 1379604 | 2/1975 | United Kingdom . | |

*Primary Examiner*—Dennis L. Taylor

*Attorney, Agent, or Firm*—Scrivener, Parker, Scrivener & Clarke

[57] ABSTRACT

Shoring sheets are provided with a continuous rack extending for the full height of the sheet engageable by a ratchet jack supported on the ground surface at the side of a trench or hole to enable the sheets to be jacked up and down. Similar sheets may be attached to the upper ends of those sheets to increase the depth of shoring for deep holes. The jacks may be mounted on wheels running on rails, and the rails may be mounted on rollers running on the ground.

18 Claims, 9 Drawing Figures

FIG. 5
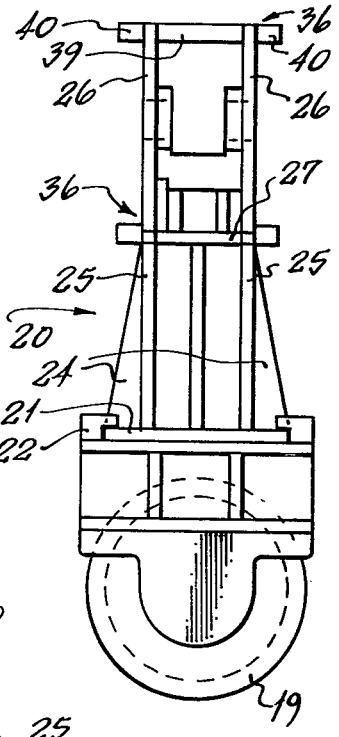
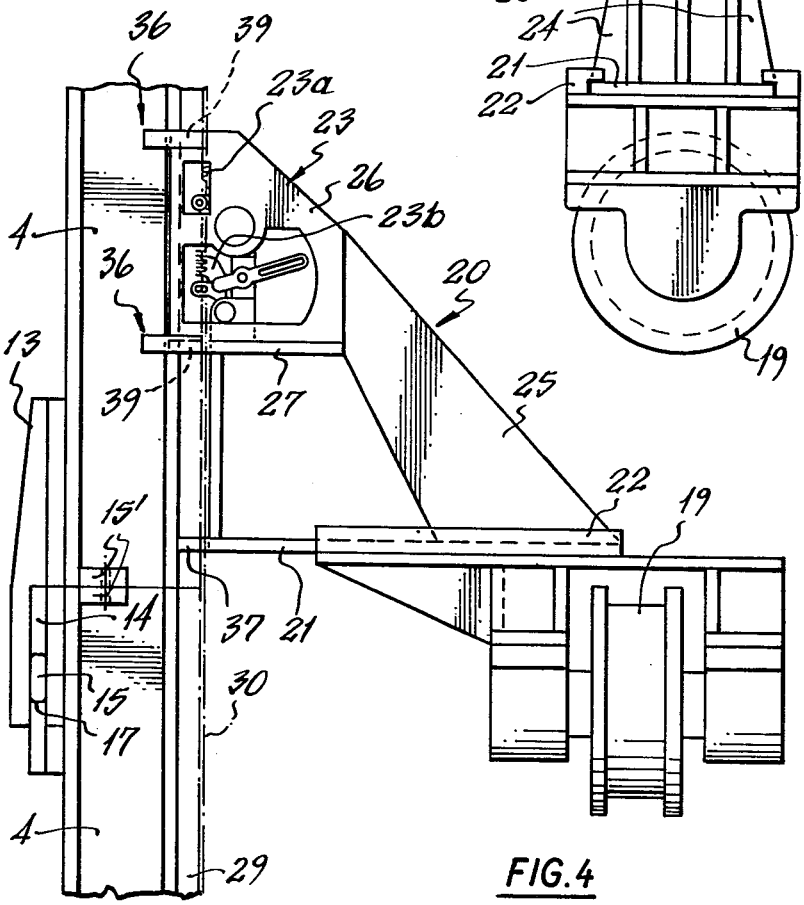
FIG. 4

SHORING ASSEMBLY FOR A TRENCH OR HOLE

SPECIFIC DESCRIPTION

This invention relates to a shoring assembly for supporting the sides of a trench or hole in the ground.

It is common practice to line a hole or trench in the ground with boards or sheets and to insert struts extending across the trench or hole to hold the boards or sheets in position, to enable work to be carried out safely in the bottom of the trench or hole. A problem which is encountered is that the boards or sheets require frequent movement as the trench or hole is extended or deepened.

In order to tackle this problem various trenching frames have been proposed which are moved along and within a trench as digging proceeds and which are provided with means to support the walls of the trench immediately behind the advancing front wall of the trench. Such frames tend to to very heavy, are difficult to maneouvre in the trench and are not easily moved from site to site.

An example of a trenching frame is that described in U.K. Pat. No. 1 295 940. That frame is provided with a vertically movable guide frame to which shoring panels are attached for pushing the panels into the ground below the level of the bottom of the trench, vertical movement of the guide frame being effected by hydraulic cylinders acting between the main frame and the guide frame.

It has previously been proposed in U.S. Pat. No. 4,002,035 to support the shoring assembly from a self-propelled carrier movable at ground level and straddling the margins of the trench. A shoring frame supported within the carrier is movable relative to the carrier for raising and lowering the frame into the trench. Movement of the shoring frame is effected again by means of a series of hydraulic jacks acting between the carrier and the shoring frame.

One problem with this arrangement is that it is again relatively complex and therefore heavy and costly.

Another problem is that, although there is provision for moving the connections between the hydraulic cylinders and the shoring frame, the stroke of the cylinders is limited, so that the vertical travel of the frame cannot easily be adjusted and will always be restricted.

According to the invention a shoring assembly for supporting the sides of a trench or hole in the ground comprises two shoring sheets which are arranged substantially vertically in use to support opposite sides of the trench or hole, a respective jack adapted to be supported on the surface of the ground adjacent to the respective sheet and adapted to engage with a substantially vertically extending jacking formation provided on the respective sheet to enable the sheets to be raised and lowered by the jacks, and means adapted to hold the sheets apart in use.

Such an assembly may be made relatively light in weight so as to be readily movable in use and from site to site. Since the depth of the shoring sheets in the trench may be adjusted by the jacks the assembly can be readily adjusted to fit trenches and holes of different depths.

The jacking formation preferably faces outwardly of the trench.

Preferably each jacking formation comprises a rack which may comprise a member of particularly hard material secured to the remainder of the sheet.

Any convenient jacking mechanism may be used, but preferably the jack is of the railway kind in which two ratchet pawls alternately engage with the rack during jacking, one pawl bearing the load as the other is stepped by one tooth of the rack.

Each sheet is preferably provided with a guide means extending parallel to the respective jacking formation and adapted to co-operate in use with a guide member of the respective jack to restrain in use horizontal movement apart of each jack and the respective sheet.

The two shoring sheets may be adapted to be releasably connected respectively to two further sheets to increase the height of the shoring, and if desired yet further sheets may be secured to those, particularly when shoring the sides of a deep hole.

When the shoring assembly is intended to be used with a trench each jack may be mounted on a respective wheel for running on rails laid on the ground along each side of the trench.

Further jacks may then be provided for turning the wheels to advance the assembly along the trench.

A shoring assembly for a trench and a modification thereof each in accordance with the invention will now be described, by way of example only, with reference to the accompanying drawings in which:

FIG. 4 is an enlarged view of one of the jacking assemblies shown in FIG. 1;

FIG. 5 is a view of the jacking assembly looking from the right in FIG. 4;

Figure 1:
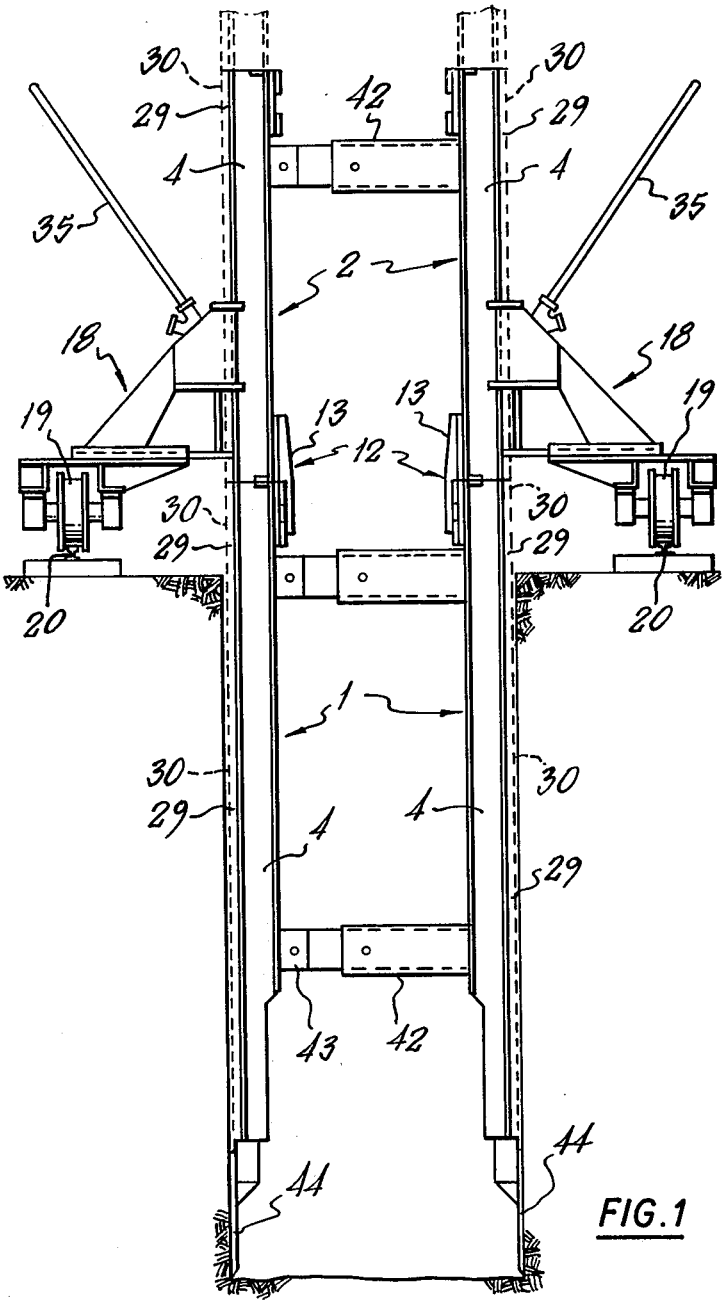
FIG. 1 is a transverse cross-section of a trench showing the shoring assembly in end elevation looking from the left in FIG. 2.
Figure 2:
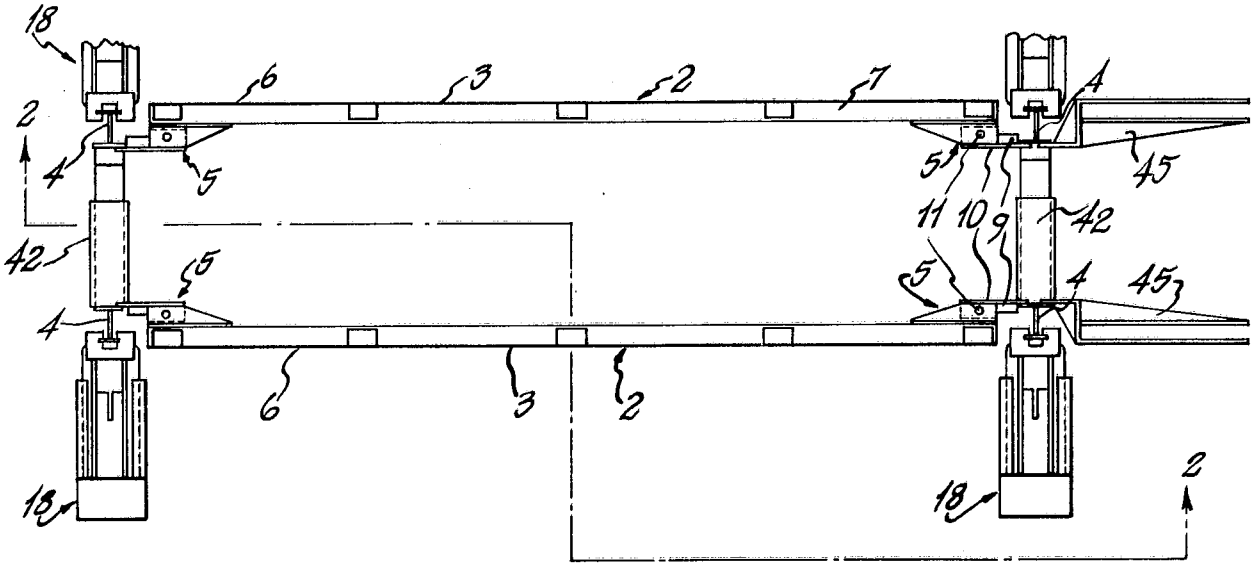
FIG. 2 is a plan view of the assembly.
Figure 3:
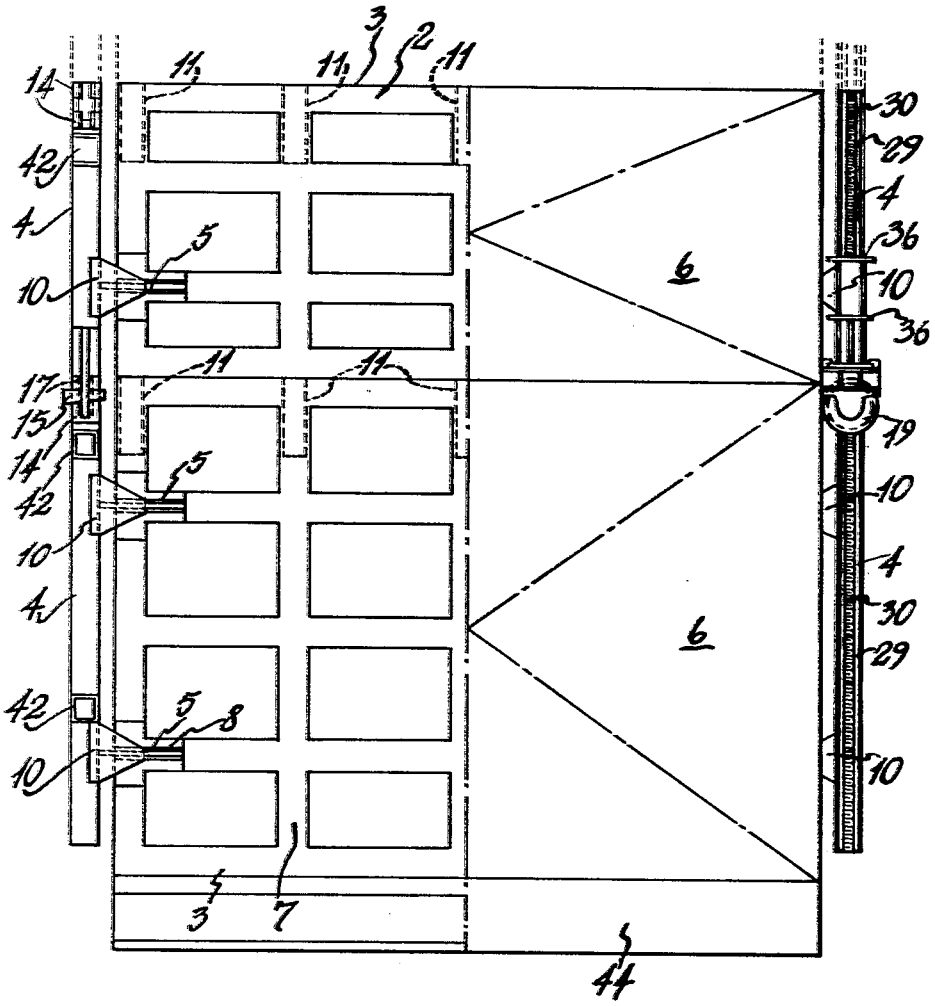
FIG. 3 is a section on the line 2—2 of FIG. 2.

With reference to FIGS. 1 to 3, the shoring assembly comprises a pair of primary vertical shoring sheets 1 detachably secured at their upper ends to respective secondary shoring sheets 2. Each shoring sheet comprises a panel 3 secured at its front and rear vertical edges to respective vertical I-section girders 4 by releasable securing means 5. Each panel 3 comprises a metal sheet 6 presenting a smooth unobstructed outer surface to the trench wall and reinforced on its inner face by a lattice-work of horizontal and vertical channel-section members 7. The releasable securing means 5 each comprises an inwardly facing channel-section bracket 8 welded to members 7 at a junction between a horizontal and a vertical member, and a shoe 9, shown in FIG. 2, welded to a triangular plate 10 of which the base is welded to the inner flange of the adjacent girder 4, shoe 9 being received within bracket 8 and being retained therein by a bolt, now shown, passing through registering holes 11, shown in FIG. 2, in the bracket 8 and shoe 9.

The vertical members 7 of each panel 3 are open at their upper ends to receive box-section spigots 11, FIG.

3, projecting downwardly from the corresponding members 7 of the secondary panel to provide accurate location of the primary and secondary panels and prevent a step between the outer surfaces of the adjacent panels. The adjacent shoring sheets are releasably connected together by wedge joints 12, shown most clearly in FIGS. 3 and 4, between girders 4 of adjacent sheets. Each joint 12 comprises an elongate vertical plate 13 welded to the inwardly facing flange of the girder 4 of the secondary sheet and overlapping with the upper end of the girder of primary sheet, and an array of four projections 14 welded to the lower girder 4 to define crossed vertical and horizontal slots 16 and 17 respectively, the overlapping part of plate 13 being received in the vertical slot 16, and a wedge 15 passing through a suitably shaped hole in plate 13 being received in the horizontal slot 17. Also, horizontal plates 15 welded to girders 4 are bolted together to provide additional connections between the girders.

Figure 6:
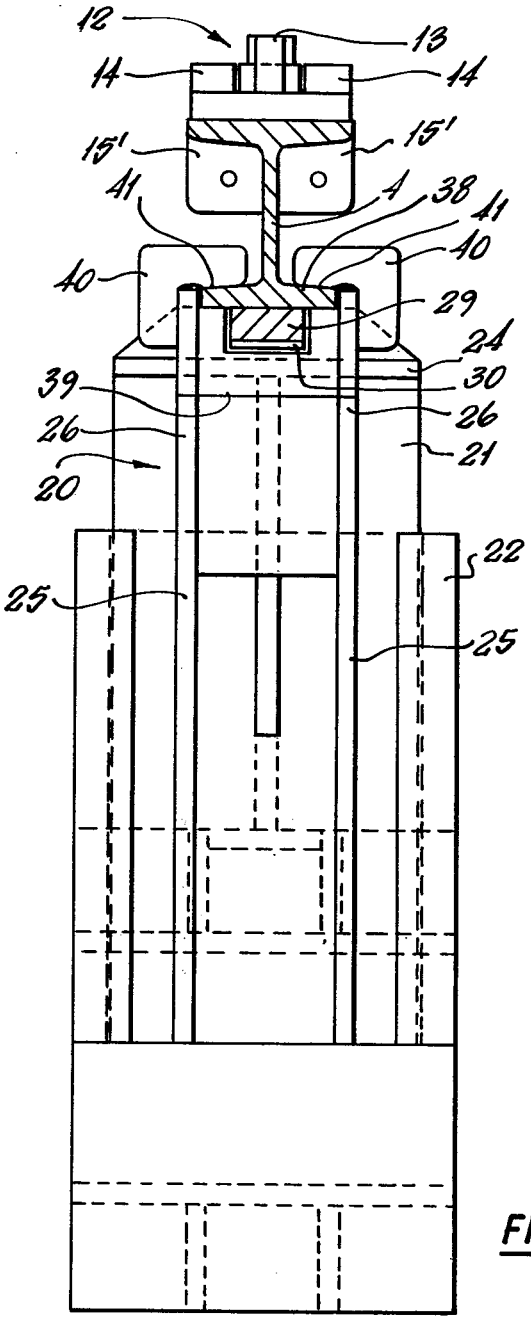
FIG. 6 is a plan view of the jacking assembly of FIG. 4 but on a larger scale and showing how the shoring sheets are guided by yokes.

The shoring sheets are supported by four identical jacking assemblies 18 provided with flanged wheels 19 running on two parallel rails laid on the surface of the ground on either side of the trench. With reference to FIGS. 4 to 6, each jacking assembly comprises a fabricated jacking head 20 of substantially right-angle triangular outline, as shown in FIG. 4, incorporating an oblong-rectangular horizontal base plate 21 directed transversely of the trench on which is slidable a shoe 22 mounting wheel 19. Shoes 22 enable the transverse position of wheels 19 to be adjusted to enable the rails 20' to be positioned a substantial distance from the edges of the trench when desirable. Any suitable means may be provided for locking each shoe 22 to the respective plate 21 in use, such as a vertical peg passing through shoe 22 and one of a series of holes in the associated plate 21.

Each jacking head 20 comprises a housing 23 for a pawl assembly supported above plate 21 by a vertical plate 24 and by spaced parallel plates 25. The housing 23 comprises vertical, parallel, apertured sidewalls 26 connected together at their lower ends by a housing base plate 27.

Each girder 4 has welded to it on its outwardly facing flange 28, shown in FIG. 6, and centrally of the flange 28 a hardened outwardly facing rack 29 of oblong-rectangular transverse cross-section extending for the full length of the girder 4 and provided with a continuous series of horizontally extending plain teeth 30. The pawl assembly located in each housing 23 is of the well-known railway kind in which two pawls 23*a*, 23*b* located one above the other alternately co-operate with the teeth 30 of the rack 29 to raise the rack on reciprocation of a handle 35. One pawl takes the load on the rack whilst the other is raised or lowered by one rack tooth, and vice versa.

Of course, with such a pawl assembly the load is lifted by manual force, but on lowering the weight of the load provides the force to move the load downwards.

In order to prevent horizontal movement apart of the jacking assemblies and sheets and to prevent tilting of the sheets relative to the jacking assemblies, guide members are provided in the form a pair of vertically spaced yokes 36 in conjunction with the inner free end 37 of plate 21, and each of the guide members co-operates with outer flange 38 of the respective girder 4, flange 38 constituting a guide means extending for the full height of the shoring sheet and parallel to the respective rack 29. Each yoke 36 comprises a C-shaped horizontal plate 39 extending between the parallel plates 26 and welded thereto, and a pair of L-shaped horizontal plates 40 welded to the outer faces of the respective plates 26, and the yoke extends around the flange 38 and around rack 29 to restrict relative horizontal movement of the jack assembly and girder 4. The free ends of the plate 39 bear against the outer surface 38 of girder flange 38, and the arms of plates 40 which are directed towards the central flange of the girder respectively bear against inwardly directed surfaces 31 of flange 38 to restrain movement in the direction transversely of the trench, and the parallel plates 36 are engageable with the free edges of flanges 38 to limit movement in the longitudinal direction of the trench.

The shoring sheets for the two sides of the trench are held apart in use, as shown in FIGS. 1 and 2, by conventional adjustable braces 42 which each comprise two telescopable square-section tubes of which the larger section one fits over and is secured to a square-section tubular lug provided on one girder 4, and the smaller section one is detachably secured at 43 to a similar lug provided on the complementary girder of the opposing sheet. The smaller tube is provided with a series of holes and the larger tube with one hole through which a peg is passed to lock the brace.

As shown in FIGS. 1 and 3, the panels of the primary sheets 1 are provided at their lower ends with blades 44 flush with the respective sheets 3 to assist in lowering of the primary sheets in a trench of which the walls are not absolutely vertical.

If desired the trailing edge of a sheet may be provided at its trailing edge, as shown in FIG. 2 with pile guide assemblies 45 defining vertical recesses to enable vertical piles to be driven into the base of the trench to support the trench walls when it is necessary for the trench to be left open for inspection purposes.

It will be appreciated that since the rack 29 is a continuous one, the jacking assemblies may be disengaged completely from the shoring sheets for movement from site to site.

When a new trench is being excavated the rails 20' are laid alongside the first part of the trench, the jacking assemblies are assembled onto the respective girders 4, and the primary sheets are connected together by the corresponding braces 42 such that the primary sheets are supported above the trench, substantially in the positions occupied by the secondary sheets in FIG. 1. The levers 35 of the jacks are then operated to lower the primary sheets into the trench. When the upper ends of the primary sheets have almost reached the level of the top of the jacking assemblies, the secondary sheets are brought into position and are secured by wedges 15 to the primary sheets. Lowering of the sheets can then continue, and if necessary further sheets similar to the secondary sheets may be successively secured to the upper ends of the sheet assemblies for deep trenches.

As the trench is extended the entire jacking assembly may be moved on wheels 19 along the trench by any suitable means, new rails 20' being laid as necessary. When the trench is being dug through uneven ground it will often be necessary to adjust the depth of sheeting in the trench as the assembly is moved along but this is easily accomplished. Lifting may also be required to negotiate a service connection.

Means may be provided for preventing the racks from becoming clogged with soil, or means may be provided for cleaning each rack. For example a rotary brush could be located below the jack housing 23 and operated by the jacking handle such that the rack is cleaned during retraction of the sheets from the trench and before the rack is engaged by the ratchet pawls.

Alternatively, respective strips of metal may be mounted on respective automatically retracting reels carried beneath each jack housing 23, with the strips extending downwards in contact with the racks to cover them, the free ends of the strips being attached to the bottom of the respective girders 4.

The modified assembly of FIGS. 7 to 9 will now be described. This assembly incorporates a modified rail assembly, a vertically movable blade and a tow bar assembly, but in other respects it is substantially the same as the assembly of FIGS. 1 to 6 and corresponding reference numerals have been applied to corresponding parts. In FIGS. 8 and 9 the direction of forward movement of the shoring assembly is towards the right, and in FIG. 7 it is towards the reader.

Figure 7:
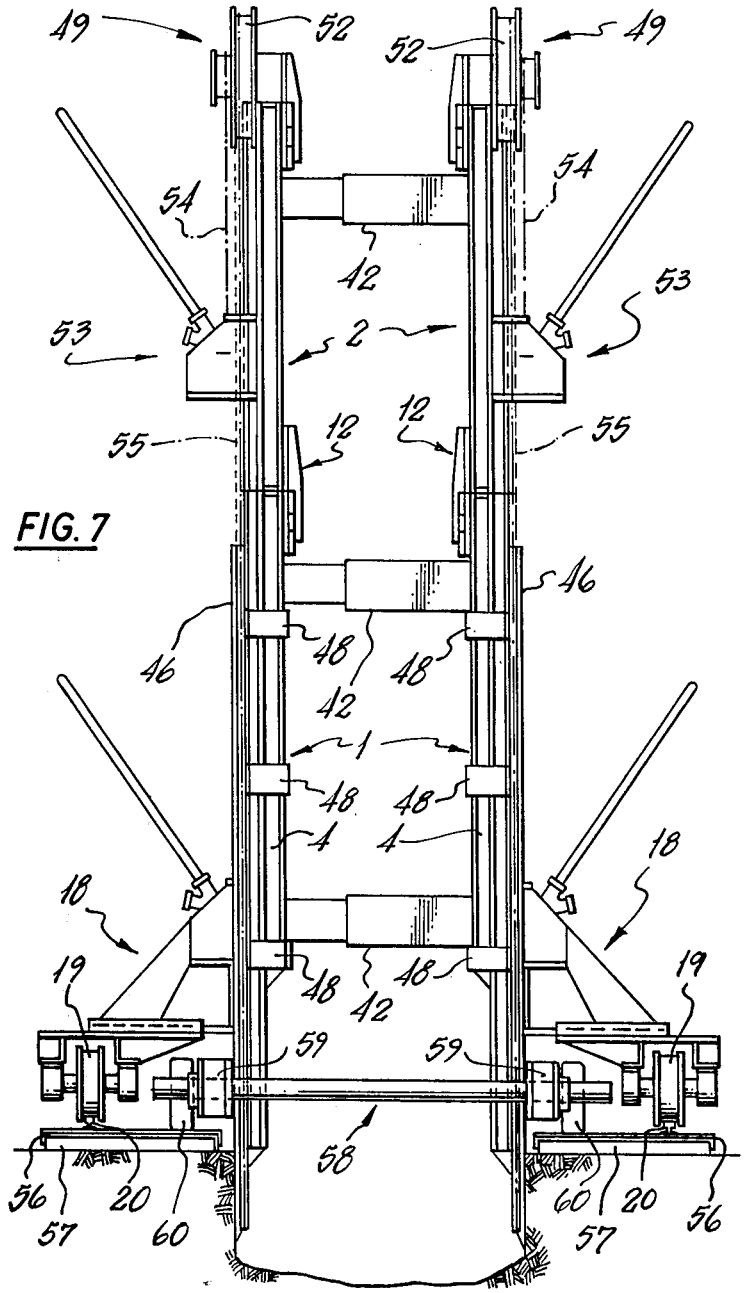
FIG. 7 is a view similar to FIG. 1 but of a modification.
Figure 8:
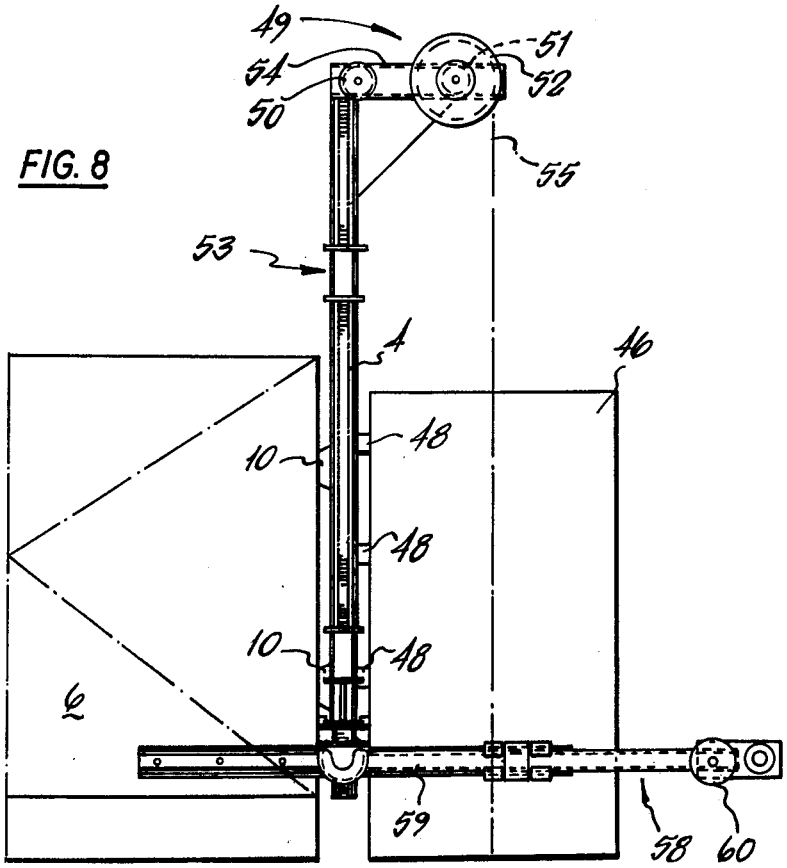
FIG. 8 is a view corresponding to the right hand part of FIG. 3 but of the modification and showing the vertically movable cutting plate and a tow bar assembly.
Figure 9:
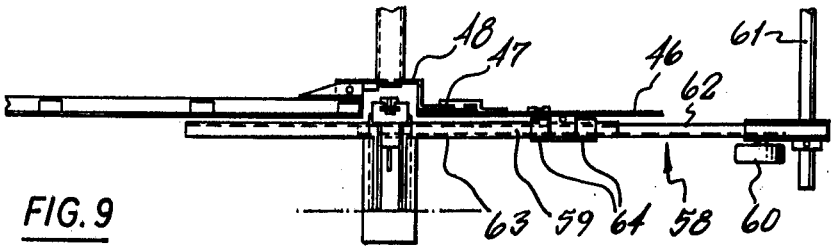
FIG. 9 is a plan view of the parts shown in FIG. 8.

With reference to FIGS. 7 to 9, vertically movable cutting blades 46 lying in vertical planes are carried by the front girders 4 of the shoring sheets 1. Each blade 46 is slidably mounted on a respective slide 47 carried by three forwardly extending cranked brackets 48 welded to the respective girders 4. The blades 46 are vertically movable on slides 47 by means of respective pulley assemblies 49 mounted on the upper ends of girders 4. Each pulley assembly comprises first, second and third pulleys 50, 51 and 52 respectively, the second pulley 51 and the third pulley 52 being keyed together. Further jacks 53 of identical construction to the upper parts of the jacks 18 are vertically movable on the upper parts of girders 4 and control the vertical movement of the blades 46 by means of the respective pulley assemblies 49. A respective first rope 54 is secured at one end to the respective jack 53, passes over the respective first pulley 50, and is wrapped around the respective second pulley 51. A respective second rope 55 wound around the respective third pulley 52 is attached to the top of the respective blade 46. The relative sizes of the pulleys 51 and 52 give a three to one step-up ratio between movement of the jacks 53 and movement of the blades 46.

It will be appreciated that the blades 46 will cut projections from the sides of the trench as the shoring assembly is moved forwards.

With reference to FIG. 7 the rails 20' in the modified assembly are mounted on respective elongate plates 56 of length about twice the lengths of the shoring sheets and which are connected together by rigid cross members at their front and rear ends to form a rectangular base assembly. The plates 56 are movable over the ground on longitudinally spaced rollers 57. Rails 20' extend for the full length of plates 56. Thus the base assembly carrying rails 20' can be pulled forwards along the ground on rollers 57 whilst the shoring sheets are stationary, and then the shoring sheets can be moved forwards on the rails 30 as the trench is extended. This avoids the need to lay new rails 20' on the ground and enables the shoring sheets to be moved more easily.

A tow bar assembly 58 for moving the shoring sheets comprises parallel telescopic draw bars 59 adjustably connected at their rear ends to the respective jacks 18 and with their front ends mounted on respective wheels 60 and connected together by a tubular cross-member 61. Each draw bar 59 comprises a smaller diameter front member 62 slidable at its rear end within a rear member 63 of greater diameter. The extent of the sliding movement is controlled by adjustable stops 64. As a trench is extended by an excavator the excavator bucket can be used to push forwardly on the bar 61 to draw the shoring sheets forwards. Then, if works needs to be done beneath the new position of bar 61 the bar 61 may be pushed rearwards without moving the sheets, the rearward movement of bar 61 being accommodated by the draw bars 59.

A further modified assembly for use in shoring a vertical square hole comprises four vertical sheets each of which is adapted to be engaged by a respective pair of horizontally spaced-apart jacks which are adapted to stand on the surface of the ground adjacent to the hole. The adjacent edges of the sheets are adapted to having a sliding engagement with one another to enable at least some relative vertical movement of the sheets so that one sheet may be jacked at a time. Conveniently at each corner one sheet is provided with an inwardly directed vertical rib spaced inwardly from one edge of the sheet by substantially the thickness of the mating sheet to enable the mating sheet to abut at its end the inner face of the other sheet and to engage with the rib. Thus each sheet is held against inward movement at the corner by the mating sheet. A respective substantially horizontal tie extends at 45° across each corner of the shield and is connected by removable pins at its ends to the adjacent sheets to brace the corners of the shield yet allow some relative vertical movement of the sheets through flexing of the tires. The tie may incorporate resilient means to permit the flexing.

A sheet may be provided with a removable portion to enable, for example, connections to be made below ground level between a pipe in the hole or trench and a branch pipe which enters the hole or trench from one side.

If desired any of the jacks may be power-operated.

I claim:

1. A shoring assembly for supporting the sides of a trench or hole in the ground comprising two vertical shoring sheets engaging with opposite sides of the trench or hole, a respective substantially vertically extending rack provided on each of said sheets, a respective jack for raising and lowering each sheet, a jacking head of each jack, a base of each jack secured to the respective jacking head, each jacking head being engaged with the respective rack, each base being independently supported on the surface of the ground adjacent to the trench or hole, means holding said sheets apart, a respective guide means provided on each sheet and extending parallel to the respective rack, a respective guide member secured to the respective jacking head and co-operating with the respective guide means whereby each jack is restrained from moving horizontally relative to the respective sheet.

2. A shoring assembly as in claim 1, wherein each jacking head comprises manually operable ratchet mechanism co-operating with the respective rack.

3. A shoring assembly as in claim 1 wherein a further guide member is secured to each jacking head and is spaced vertically from said first guide member, said further guide member also co-operating with the respective guide means.

4. A shoring assembly as in claim 1 including a further substantially vertically extending rack on each sheet horizontally spaced apart from said first rack, and respective further jacks engaging with said further racks.

5. A shoring assembly as in claim 1 and including two further sheets releasably connected respectively to the lower ends of said two sheets to increase the height of the shoring.

6. A shoring assembly as in claim 1, including blades along the lower edges of said two sheets.

7. A shoring assembly as in claim 1 wherein each sheet comprises a panel, and each rack is provided on a respective girder secured to the respective sheet.

8. A shoring assembly as in claim 7 wherein each girder is releasably secured to one vertical edge of the respective panel.

9. A shoring assembly as in claim 7 wherein said girder constitutes the respective guide means.

10. A shoring assembly as in claim 9 wherein said girder is of I-section and each guide member comprises a yoke of which the free ends are directed towards opposite faces of the central flange of the I-section.

11. A shoring assembly as in claim 4, wherein said base of each jack is mounted on a respective wheel co-operating with a rail supported on the ground.

12. A shoring assembly as in claim 11, wherein each rail is longer than said sheets, and including respective elongate base plates on which said rails are mounted, rollers laid on the ground and supporting said base plates, and means rigidly interconnecting said base plates whereby said base plates are movable together over the ground.

13. A shoring assembly as in claim 1 wherein said means holding said sheets apart comprises struts of adjustable length bearing at their opposite ends on the respective girders.

14. A shoring assembly as in claim 1 wherein said jacks are connected to each other solely through their connections with the respective sheets.

15. A shoring assembly as in claim 1 wherein said racks are of substantially the same length as the height of said sheets.

16. A shoring assembly as in claim 15 wherein each rack has upper and lower ends which lie substantially at the respective heights of the upper and lower ends of the respective sheet.

17. A shoring assembly as in claim 14 wherein each jacking head is disengageable from the respective rack, and each guide member is disengageable from the respective guide means, whereby each jack may be disconnected from the respective sheet.

18. A shoring assembly as in claim 1 including a respective vertical cutting blade disposed on the front of each sheet, a respective vertical slide connecting said blade to the respective sheet for permitting vertical movement of said blade relative to the respective sheet, and means mounted on each sheet and connected to the respective blade for raising the blade.

* * * * *